US006260492B1

(12) United States Patent
Adams et al.

(10) Patent No.: US 6,260,492 B1
(45) Date of Patent: Jul. 17, 2001

(54) METHOD AND APPARATUS FOR BURNING FUEL IN THE FREE BOARD OF A PRESSURIZED FLUIDIZED BED WITH SOLIDS RECIRCULATION

(75) Inventors: Christopher Adams; Jim Anderson; Mats Andersson; Roine Brännström, all of Finspång (SE); John Weatherby, Knutsford (GB)

(73) Assignee: ABB Carbon AB, Finspang (SE)

( * ) Notice: Subject to any disclaimer, the term of this patent is extended or adjusted under 35 U.S.C. 154(b) by 0 days.

(21) Appl. No.: 09/171,012

(22) PCT Filed: Apr. 10, 1997

(86) PCT No.: PCT/SE97/00597

§ 371 Date: Dec. 22, 1998

§ 102(e) Date: Dec. 22, 1998

(87) PCT Pub. No.: WO97/39280

PCT Pub. Date: Oct. 23, 1997

(30) Foreign Application Priority Data

Apr. 12, 1996 (SE) ..... 9601392

(51) Int. Cl.[7] ..... B01J 8/00; B01J 8/18; F23J 3/00

(52) U.S. Cl. ..... 110/348; 110/212; 110/245; 110/262; 110/347; 110/344; 431/7; 422/139; 422/234; 422/145

(58) Field of Search ..... 110/204, 210, 110/212, 216, 245, 260, 261, 262, 263, 347, 348, 344; 122/4 D, 211; 432/215; 431/7; 422/139, 143, 145, 234

(56) References Cited

U.S. PATENT DOCUMENTS

| | | | | |
|---|---|---|---|---|
| 4,021,184 | | 5/1977 | Priestley | 431/7 |
| 4,103,646 | | 8/1978 | Yerushami | 112/4 D |
| 4,714,032 | | 12/1987 | Dickinson | 110/347 |
| 4,730,563 | * | 3/1988 | Thornblad | 110/216 |
| 4,843,981 | * | 7/1989 | Goldbach et al. | 122/4 D X |
| 5,190,451 | * | 3/1993 | Goldbach | 110/212 X |
| 5,396,849 | * | 3/1995 | Boyd | 110/263 X |

FOREIGN PATENT DOCUMENTS

| | | |
|---|---|---|
| 38 13 742 A1 | 11/1989 | (DE) . |
| 44 09 057 A1 | 9/1995 | (DE) . |
| 0 176 293 B1 | 4/1986 | (EP) . |
| 0 363 812 A2 | 4/1990 | (EP) . |
| 460 148 | 9/1989 | (SE) . |
| 470 222 | 12/1993 | (SE) . |
| WO 91/05205 | 4/1991 | (WO) . |
| WO 93/22600 | 11/1993 | (WO) . |

* cited by examiner

*Primary Examiner*—Ira S. Lazarus
*Assistant Examiner*—Ljiljana V. Ciric
(74) *Attorney, Agent, or Firm*—Connolly Bove Lodge & Hutz, LLP

(57) ABSTRACT

A method of combustion in a pressurized, fluidized bed and in the freeboard thereof. The combustion method is further characterized by the recirculation of solid sulfur absorbing materials. A gas channel, designed so as to prevent fluidizing gas from entering the channel from below, is provided such that it opens to the freeboard and to a separating member which separates particulate matter from the combustion gasses.

30 Claims, 7 Drawing Sheets

METHOD AND APPARATUS FOR BURNING FUEL IN THE FREE BOARD OF A PRESSURIZED FLUIDIZED BED WITH SOLIDS RECIRCULATION

REFERENCE TO RELATED APPLICATION

The present application is a 371 of PCT International Application No. PCT/SE97/00597, filed Apr. 10, 1997.

BACKGROUND OF THE INVENTION AND PRIOR ART

The present invention refers to a method of combustion in a combustion chamber enclosing a pressurized fluidized bed and a space located above the bed, comprising the steps of: feeding an oxygen-containing gas into the bed; supplying a fuel to the bed; supplying a particulate absorbent to the bed for the absorption of undesirable substances released during the combustion; collecting in the space combustion gases formed during the combustion; discharging the combustion gases from the combustion chamber; and separating solid material from the combustion gases. Moreover, the invention refers to a combustion plant comprising a combustion chamber, which is provided to enclose a pressurized fluidized bed and a space located above the bed and in which a combustion of a fuel is intended to be performed while forming combustion gases, at least a first fuel supply member arranged to supply the fuel to the bed, means arranged to supply an oxygen-containing gas to the bed, means arranged to supply an absorbent to the combustion chamber, and a purification device for purifying the combustion gases, the purification device comprising a separating member arranged to separate particulate material from the combustion gases.

It is known to combust different fuels in a bed of particulate, incombustible material, in which the bed is supplied with combustion air from beneath through nozzles in such a manner that the bed becomes fluidized. One differs between different types of such combustion in a fluidized bed, which operate according to different principles and under different conditions. Firstly, one differs between an atmospheric bed and a pressurized bed. In comparison with an atmospheric bed a pressurized, fluidized bed is characterized by a small plant size in relation to the effect produced, by a high efficiency, and in that the combustion occurs under advantageous conditions from an environmental and economical point of view. A pressurized bed may have a larger height than an atmospheric bed since one may operate with greater pressure drops. Among the atmospheric beds, circulating beds are frequently used in which the bed material is permitted to circulate through a separating device in order to be recirculated to the bed. In such a way possibly unburnt fuel may be recirculated, which improves the efficiency of the combustion, and also absorbent material not used for absorption of in the first place sulphur, which decreases the discharge of contaminants from the combustion. However, such circulating beds operate with relatively high fluidizing velocities, in typical cases in the order of 5through 12 m/s. Fluidizing velocity means the velocity that the gas would have had if it would have flowed through the combustion chamber without the presence of particles. This causes problems with erosion on, for instance, the steam tube arrangement provided in bed in such a way that the lifetime thereof significantly decreases. Furthermore, one may discern the so called bubbling beds in which the fluidizing velocity is relatively low, in typical cases between 0.5 and 2 m/s. Such a bed is relatively well defined in a vertical direction and there is formed a space, a so called freeboard, in the combustion chamber above the bed. In this freeboard a relatively small amount of dust particles are present in comparison with a circulating bed but there is essentially no pressure drop across the freeboard.

Recently, attempts have been made to provide a certain circulation also in pressurized beds by supplying the combustion gases leaving the combustion chamber to a cyclone for separation of solid material, which is recirculated to the combustion chamber. In order to obtain the desired effect concerning the degree of utilization of the absorbent and the combustion efficiency by the recirculation, the solid material should be supplied at the bottom of the fluidized bed. This means that the pressure drop which is present in the bed and in the cyclone, in typical cases about 0.5 bars, has to be overcome.

In order to overcome this pressure drop, it has been suggested to provide a dosing device, for example of a cell feeding type, at the end of a recirculating pipe provided preferably vertically and connecting the cyclone to a combustion chamber. The dosing device may comprise a rotatable shutter provided on the pipe and having a weight which in normal cases keeps the shutter in a closed position. When the amount of material in the pipe is sufficient, the weight thereof will overcome the weight of the shutter which means that the shutter is opened and the material is discharged. Such a device leads to an intermittent recirculation of solid material. However, such devices do not function in the way intended in the environment of a fluidized bed due to the movements occuring in the bed and the forces caused by these movements. Furthermore, such devices are rapidly destroyed due to the aggressive, erosive and corrosive environment.

Another solution is an L-valve located in the bed and having a vertical portion in which a column of material is built up. In order to provide a flow of material through the channel, such a device requires that gas is injected in the lower portion of the L-valve and, in order to provide stability, it is necessary to continuously measure the height of the column of material, which is very difficult, if not impossible, in the actual environment.

SE-B-460 148 suggests another way of overcoming this pressure drop. SE-B-460 148 discloses a combustion plant having a combustion chamber enclosing a pressurized fluidized bed for the combustion of a fuel while forming combustion gases. Furthermore, the plant comprises a purification of the combustion gases in several stages. In a first stage, particulate material is separated by means of a cyclone from the combustion gases and supplied to a collection chamber beneath the cyclone. Via a horizontal recirculating channel, the collected dust particles are fed back to the combustion chamber in order to improve the use of unburnt fuel and absorbent material. The recirculation is accomplished by means of an air-driven ejector blowing the material into the combustion chamber. However, such an air injection is very expensive. The gain of the absorbent utilization and the combustion efficiency is lost in the effect for the compressor providing primary air to the ejector. In addition this method leads to erosion.

It should be noted that the recirculation of solid material separated from the combustion gases means that the recirculated fine part may provide as much as 10–40% of the mass of the bed, which strongly influences the heat transfer coefficient to the tubes located in the bed. The fine part is comprised of particles having a largest diameter of about 300 to about 400 $\mu$m and an average particle diameter of about 50 to about 150 $\mu$m.

U.S. Pat. No. 4,021,184 discloses a combustion plant developed for the combustion of waste material. The plant comprises a combustion chamber for a recirculating fluidized bed. The bed disclosed in this reference is not pressurized but the plant operates at atmospheric pressure and is of a diluted type (dilute phase fluidized bed), i.e. the fluidized bed fills up the whole combustion chamber. Such a type of bed means that a very large part of the solid, hot bed material will be transported out from the combustion chamber together with the combustion gases formed during the combustion. Therefore, it is suggested that cyclones for separating dust particles from these gases be provided at the outlet of the combustion chamber and that the separated, hot dust particles are recirculated to the combustion chamber via conduit pipes connecting the cyclones with the combustion chamber. In such a manner it is possible to recover the heat energy in the dust particles leaving the combustion chamber. Thus, a recirculation may be obtained due to the low pressure drop across the bed, i.e. the whole combustion chamber. In addition, the valve mentioned (trickle valve) in the end of the conduit pipe is probably necessary.

EP-B-176 293 discloses another combustion plant having a combustion chamber which encloses a fluidized bed and in which combustion of a fuel is intended to be performed while forming combustion gases. The bed is of a bubbling type but the combustion chamber operates at atmospheric pressure. Furthermore, the plant comprises a cyclone for separating particulate material from the combustion gases and provided above the combustion chamber. The particulate material separated is conducted via a pipe back into the bed by letting the material simply fall freely through the pipe. This is possible since the bed disclosed in this document has a relatively low height, about 1 m. In addition the pressure drop is relatively small.

U.S. Pat. No. 4,103,646 discloses a plant comprising two combustion chambers, the first having a fast fluidized bed, i.e. the fluidizing velocity is between 7 and the 10 m/s, and second having a "slow", bubbling fluidized bed. The combustion gases formed in the first combustion chamber are conducted to a cyclone, where solid material is separated and fed to the second combustion chamber. In the bottom of the second combustion chamber there is a discharge channel for solid material which is then recirculated to the first fast combustion chamber by means of air injection.

SE-B-470 222 discloses a method of combustion in a combustion chamber enclosing a pressurized fluidized bed and a space located above the bed. In addition, in the combustion chamber there is a tube arrangement for generating steam to a steam turbine. The combustion is performed by feeding oxygen-containing gas into the bed and by supplying a particulate fuel to the bed. The combustion gases generated during the combustion are collected in the space and are then conducted away from the combustion chamber. Furthermore, it is known from SE-B-470 222 to raise the temperature of the combustion gases by the combustion of a complementary fuel injected into the freeboard. This combustion is especially utilized during part load operation of the plant in order to adapt the temperature of the combustion gases to an optimal temperature for the subsequent gas turbine. Such a freeboard combustion functions appropriately by the addition of such complementary fuels as volatile oils or gases. However, it is disadvantageous to need several different types of fuels for a single plant, since this makes the handling and the operation of the plant more complicated. Certainly, SE-B-470 222 suggests using fine grounded carbon as fuel for the complementary combustion. Such a combustion of carbon is disadvantageous since the combustion gases from the complementary combustion will not pass the bed, in which there is a sulphur absorbent, prior to leaving the plant. Thus, the sulphur dioxide formed during the combustion in the freeboard will pass directly to the atmosphere and will not be bound by a sulphur absorbent. Another problem of this method is that it may be difficult to combust a fuel, such as carbon, in the freeboard during part load since the temperature in the freeboard then may be too low.

SUMMARY OF THE INVENTION

The object of the present invention is to overcome the problems mentioned above and to provide a method and a combustion plant by which the discharge of undesirable substances may be reduced.

This objective is obtained by the method initially defined and characterized by the combination of recirculating the separated solid material to the combustion chamber and supplying a complementary fuel to the space for the combustion thereof in the collected combustion gases. By such a method, the combustion gases generated during the combustion of the complementary fuel will also be subjected to a separation of solid material therefrom and this separated material from the complementary fuel is recirculated to the combustion chamber and may in this manner once again be brought into contact with the combustion gases. Thus, by the method according to the invention, it is possible to absorb undesirable substances from the combustion gases formed during the combustion of a complementary fuel. A further advantage of the recirculation of solid material, such as fly ashes, to the combustion chamber is that the temperature in the freeboard may be increased by 100 to 200° C., enabling freeboard combustion of carbon at part load. Without any recirculation, it has been recognized that a certain part, an unacceptable part, of carbon supplied has passed the dust purification equipment and the turbine in an unburnt state. This problem gives great losses and frequently causes fire in the this equipment. Due to the recirculation of fly ashes according to the invention this problem has been solved.

According to an embodiment of the invention, the complementary fuel comprises a particulate fuel. Due to the relatively great content of undesirable substances, such as sulphur, in particulate fuels, this has previously not been practically usable for such freeboard combustion. In particular, the invention is advantageous when the complementary fuel comprises the same fuel as supplied to the bed. Thereby, the construction of the plant may be simplified since merely one type of fuel need to be handled. However, the complementary fuel may also comprise liquid and/or gaseous fuels. Therefore, the complementary fuel may comprise merely liquid fuel, merely gaseous fuels, a combination of these fuels or combinations of these and a particulate fuel.

According to a further embodiment of the invention, the complementary fuel is supplied during at least a part load operation of the plant in order to raise the temperature of the combustion gases. In such a way, it is possible to improve the efficiency of the combustion plant, especially when this plant comprises a gas turbine for production of electric power.

Preferably, the absorbent comprises a sulphur absorbing lime-containing substance, i.g, lime stone or dolomite.

According to a further embodiment of the invention, the material separated is supplied to a channel in such a manner that a column of material is formed therein and the column of material, due to its weight, recirculates the material in a continuous flow through a passage having a constant opening area provided in the lower portion of the channel. Thus, the discharge of the material into the combustion chamber is performed merely by the weight of the column of material and without any influencing means from the outside such as previously used auxiliary means, e.g. ejectors or the like. The operation of the plant ensures that the column of material is filled from above by the separating member. Preferably, the height of the column of material exceeds the height of the bed. Furthermore, the gas from beneath is advantageously prevented from entering the channel.

According to a further embodiment of the invention, the oxygen-containing gas is fed to the bed from beneath in such a manner that a fluidizing velocity of 0.5 through 2.0 m/s is obtained and the bed is of a bubbling type.

The object mentioned above is also obtained by the combustion plant initially defined and characterized by the combination of a channel connecting the separating member and the combustion chamber, and being arranged to recirculate the material separated to the combustion chamber, and at least a second fuel supply member arranged to supply a complementary fuel to the combustion chamber into the space located above the bed.

Preferred embodiments of the combustion plant are described hereinafter. According to one embodiment, passive means are arranged in such a manner that a column of material is formed in the channel and that they form a passage having a constant flow area in the lower part of the channel, the passage permitting that the weight of the column of material discharges the material therethrough in the continuous flow. Thus, merely the weight of the column of material will provide a continuous and uniform recirculation of separated solid material to the combustion chamber. Since the recirculation device according to the invention comprises passive means not requiring any compressors or other drive members for overcoming the pressure difference and feed out the material from the column of material, this device will be very economically advantageous, particularly concerning the manufacturing as well as the operation of the plant. Furthermore, the erosion problems following the ejector feed of the material are avoided. Thus, since the recirculating channel according to the invention does not have any movable structural elements, it will have a very high reliability.

BRIEF DESCRIPTION OF THE DRAWINGS

The invention will now be explained by means of different embodiments, defined by way of example, and with reference to the attached drawings.

DETAILED DESCRIPTION OF DIFFERENT EMBODIMENTS

Figure 1:
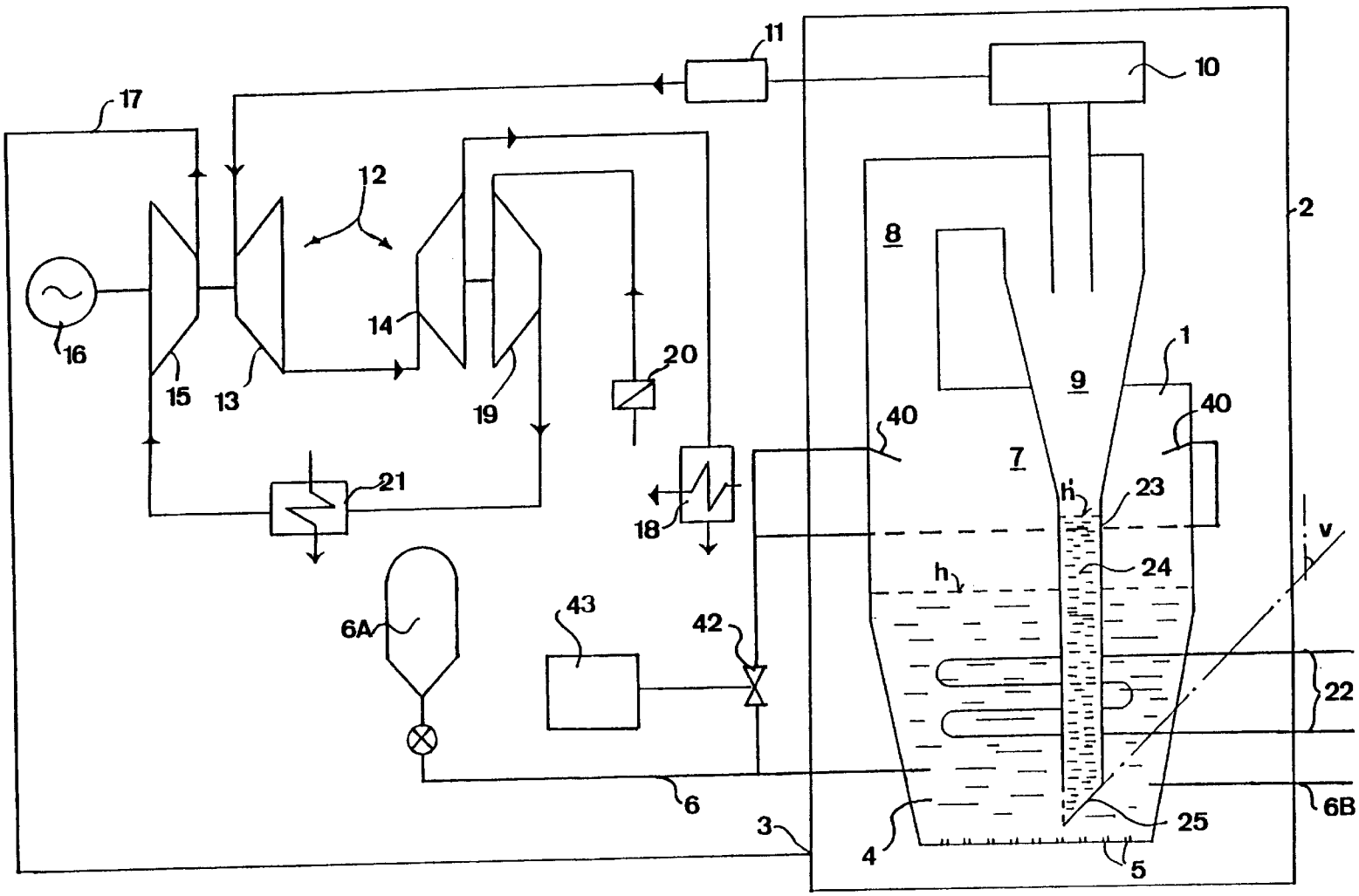
FIG. 1 discloses schematically a PFBC-power plant having a combined gas and steam cycle (the latter not shown).

The invention will now be explained with a reference to a so-called PFBC-power plant (pressurized, fluidized bed combustion). However, it should be noted that the invention also is applicable to other types of plants, in particular combustion plants without power production. A PFBC-power plant, i.e. a plant for the combustion of particulate fuel in a pressurized, fluidized bed, is schematically disclosed in FIG. 1. The plant comprises a combustion chamber 1 being housed in a pressure vessel 2, having a volume in the order of $10^4$ $m^3$ and which may be pressurized to, for example, between 7 and 30 bars (abs). Compressed oxygen-containing gas, in the example disclosed here, is supplied to the pressure vessel 2 at 3 for pressurizing the combustion chamber 1 and for fluidizing a bed 4 in the combustion chamber 1. The compressed air is supplied to the combustion chamber 1 via schematically indicated fluidizing nozzles 5 being provided in the bottom of the combustion chamber 1 for fluidizing the bed 4 enclosed in the combustion chamber 1. The air is supplied in such a manner that a fluidizing velocity of about 0.5 to 2.0 m/s is obtained and the bed 4 is of a bubbling type and may have a height h being about 2 to 6 m. It comprises a non-combustible, particulate bed material, particulate absorbent and a particulate fuel. The particle size of the bed material not circulating, the absorbent and the fuel is between about 0.5 and 7 mm. The bed material comprises, for example, ashes and/or sand and the absorbent is a lime containing material, for example dolomite or lime stone for absorption of the sulphur or possible other undesired substances released during the combustion. The fuel is supplied in such a quantity that it forms about 1% of the bed. By fuel is meant all fuels which may burn such as for example pit coal, brown coal, coke, peat, biofuel, oil shale, pet coke, waste, oils, hydrogen gas and other gases, etc. The bed material, the absorbent and the fuel are supplied to the bed 4, via a conduit 6 schematically shown, from a container 6A, for instance. The absorbent is supplied to the bed via a conduit member 6B as schematically shown. The fuel is combusted in the fluidizing air supplied to the bed 4 while forming combustion gases. These are collected in a space 7 located above the bubbling bed 4, a so called freeboard, and are then conducted via a channel 8 to a separating member 9, in the example disclosed a cyclone. From there the combustion gases are conducted to further purification devices, which are shown schematically at 10 and which for example may comprise cyclones provided in several stages. Thereafter, the combustion gases are conducted further via for example a high temperature filter 11 to a gas turbine 12 which in the example shown comprises a high pressure stage 13 and a low pressure stage 14. The high pressure turbine 13 is provided on the same shaft as the high pressure compressor 15 and a generator 16 which in this manner is driven by the high pressure turbine for producing electrical energy. The high pressure compressor 15 delivers compressed air to the combustion chamber 1 via the conduit 17.

The combustion gases expanded in the high pressure turbine 13 are conducted to a low pressure turbine 14. The combustion gases leaving the low pressure turbine 14 still comprise energy which may be recovered in an economizer 18. The low pressure turbine 14 is provided on the same shaft as the low pressure compressor 19 which is supplied with air from the atmosphere via a filter 20. The low pressure compressor 19 is thus driven by the low pressure turbine 14 and provides from its outlet the high pressure compressor 15 with air which has been compressed in a first stage. Between the low pressure compressor 19 and the high pressure compressor 15 an intermediate cooler 21 is provided for lowering the temperature of the air supplied to the inlet of the high pressure compressor 15.

The power plant also comprises a steam turbine side, which is not shown, but indicated by the arrangement in a form of a tube set 22, which is submerged in the fluidized bed 4. In the tube set 22 water is circulated evaporated and superheated by heat-exchange between the tubes and the bed material for receiving the heat produced by the combustion performed in the bed 4.

In the cyclone 9 provided in connection to the combustion chamber and also called zero step cyclone, solid particulate material is separated from the combustion gases. This solid particulate material comprises bed material and ashes as well as unburnt fuel and absorbent. It is therefore desirable to recirculate this unused material to the bed 4 to, if possible, combust unburnt fuel and utilize unused absorbent. This recirculation is performed by a recirculation device comprising a channel 23. The channel 23 is configured in such a manner that a column 24 of material is formed in the channel 23 during the operation of the plant. The column 24 of material so formed has a height h' exceeding the height h of the bed 4. Due to this height difference with gravity will influence the material in the column 24 of material in such a manner that this is fed continuously downwardly into the combustion chamber 1 and, in the examples shown downwardly into the bed 4 under the tube set 22. This height difference may be provided by a variety of different embodiments of the channel 23. The channel 23 may have an arbitrary cross-section, for instance circular, oval elliptic, rectangular, polygonal etc. In FIG. 1, the recirculation device comprises an inclined wall 25 in the lowest portion of the channel 23, which in cooperation with the channel 23 forms a passage with a constant flow area. Thus, the orifice of the channel 23 is formed by the lowest edge of the inclined wall 25 and an edge of the channel 23 thereabove. The inclined wall may have an angle v of inclination in relation to the vertical axis which amounts to about 20 to 90°, i.e. in the extreme case it is perpendicular to the vertical axis. A preferred angle v of inclination is between about 21 and 39°. The inclined wall 25 prevents the gas flowing upwardly from the nozzles 5 from entering the channel and functions as sliding surface for the material flowing downwardly. In such a manner, a column of material of the downwardly flowing material is formed. In order to reduce the recirculation velocity, the opening area of the orifice may be less than the cross-section area of the channel 23. It should be noted that the orifice in the example shown in FIG. 1 is completely located in an essentially vertical plane. Since small quantities of the combustion air flowing upwardly thus may enter the channel 23 no fluidizing of the material present in the channel 23 will take place.

FIGS. 2–5 show other embodiments of the recirculation channel 23 and the separating member 9. It should be noted that elements having a corresponding function have been provided with the same reference numerals in the different embodiments.

Figure 2:
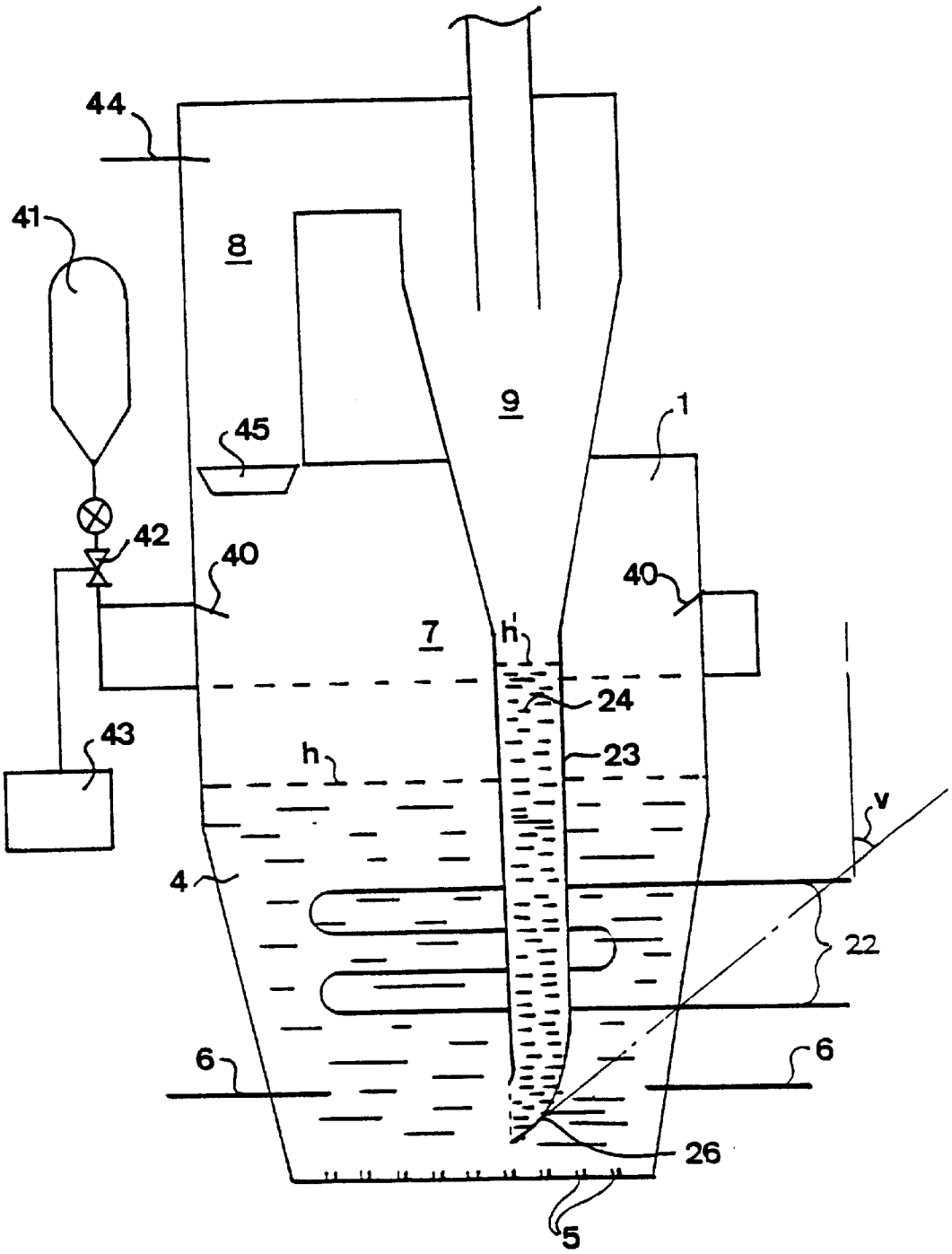
FIGS. 2–5 discloses different embodiments of a combustion chamber and a recirculation channel of the power plant according to the invention for solid material separated from the combustion gases.

The recirculation device shown in FIG. 2 comprises a relatively soft curve 26 in the lower part of the channel 23. The orifice in this example is formed by cutting the channel 23 in an essentially vertical plane. A lower tangential plane of the curve 26 at the end of the channel is inclined in relation to a vertical axis by the angle v which has the same value as in the example disclosed in FIG. 1. The curve 26 forms a passage which will prevent gas flowing upwardly from entering the channel 23 and function as a sliding surface for the material flowing downwardly. In order to reduce the recirculation velocity of the material, the channel 23 may have a smaller cross-section area at the curve 26 than upstream thereof. In addition, the cyclone 9 shown in FIG. 2 is completely enclosed in the combustion chamber 1.

Figure 3:
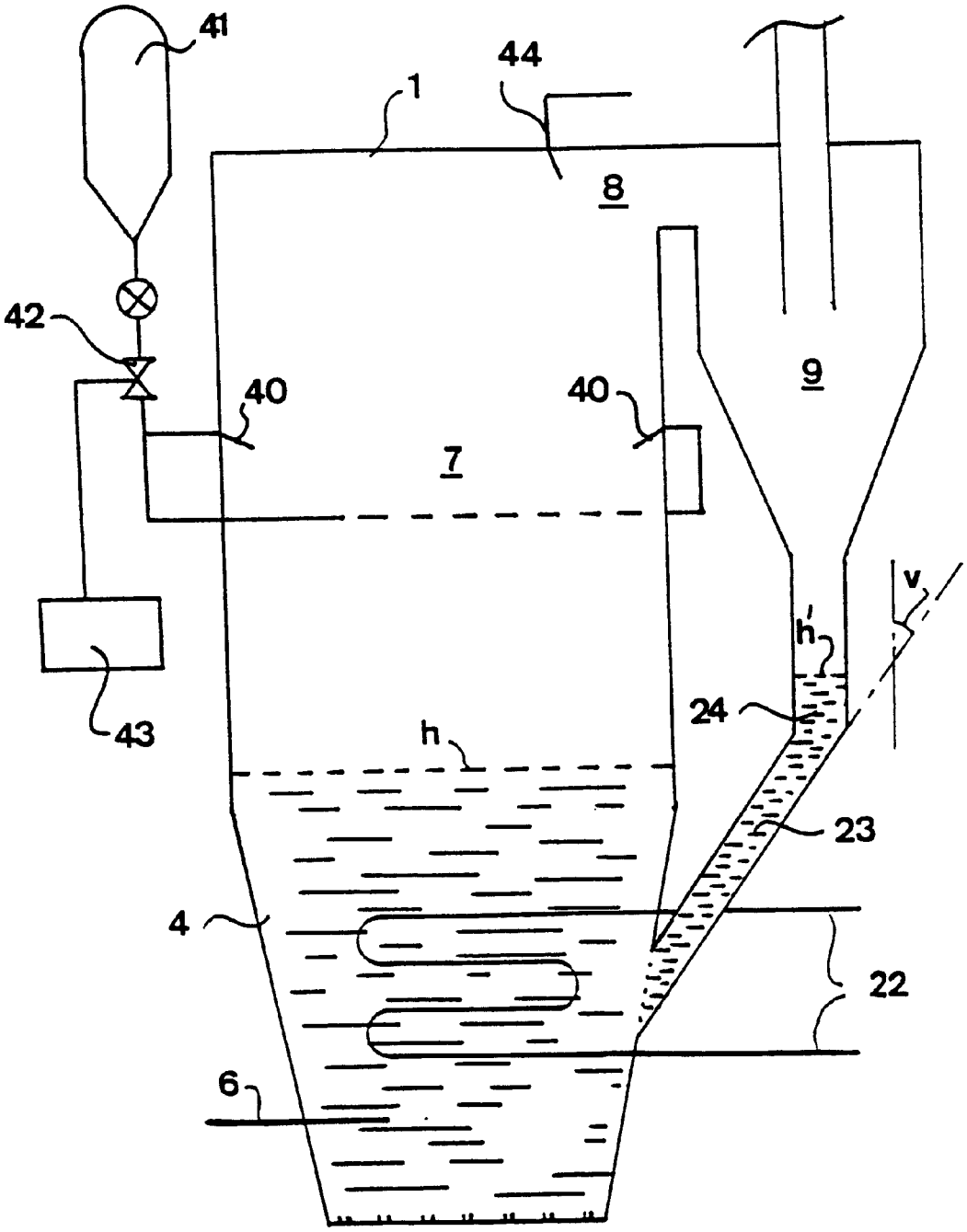

The recirculation device disclosed in FIG. 3 comprises a channel 23 which extends outside the combustion chamber 1 and in a direction which forms an angle v to a vertical axis. The channel 23 extends through a passage in the wall of the combustion chamber 1, which passage forms the orifice of the channel 23. The angle v may for example be between 10 and 50°, preferably between 21 and 39°. By means of such a sloping recirculation channel 23 the quantity of gas flowing upwardly in the channel is reduced, resulting in the formation of a column 24 of material extending upwardly above the bed 4. Merely the weight of this column 24 of material ensures an equal and continuous discharge of the solid material separated. In order to reduce the recirculation velocity of the solid material flowing downwardly, the cross-section area at the passage, i.e. in the proximity of the orifice of the channel 23, may be less than at a higher position of the channel 23. The cyclone 9 is in this example located completely outside the combustion chamber 1 and is connected therewith via the schematically disclosed pipe conduit 8. Although the orifice of the channel 23 in FIG. 3 is located at the same height as the tube set 22, it should be noted that the orifice disclosed in FIG. 3 may be located below or above the level of the tube set 22.

Figure 4:
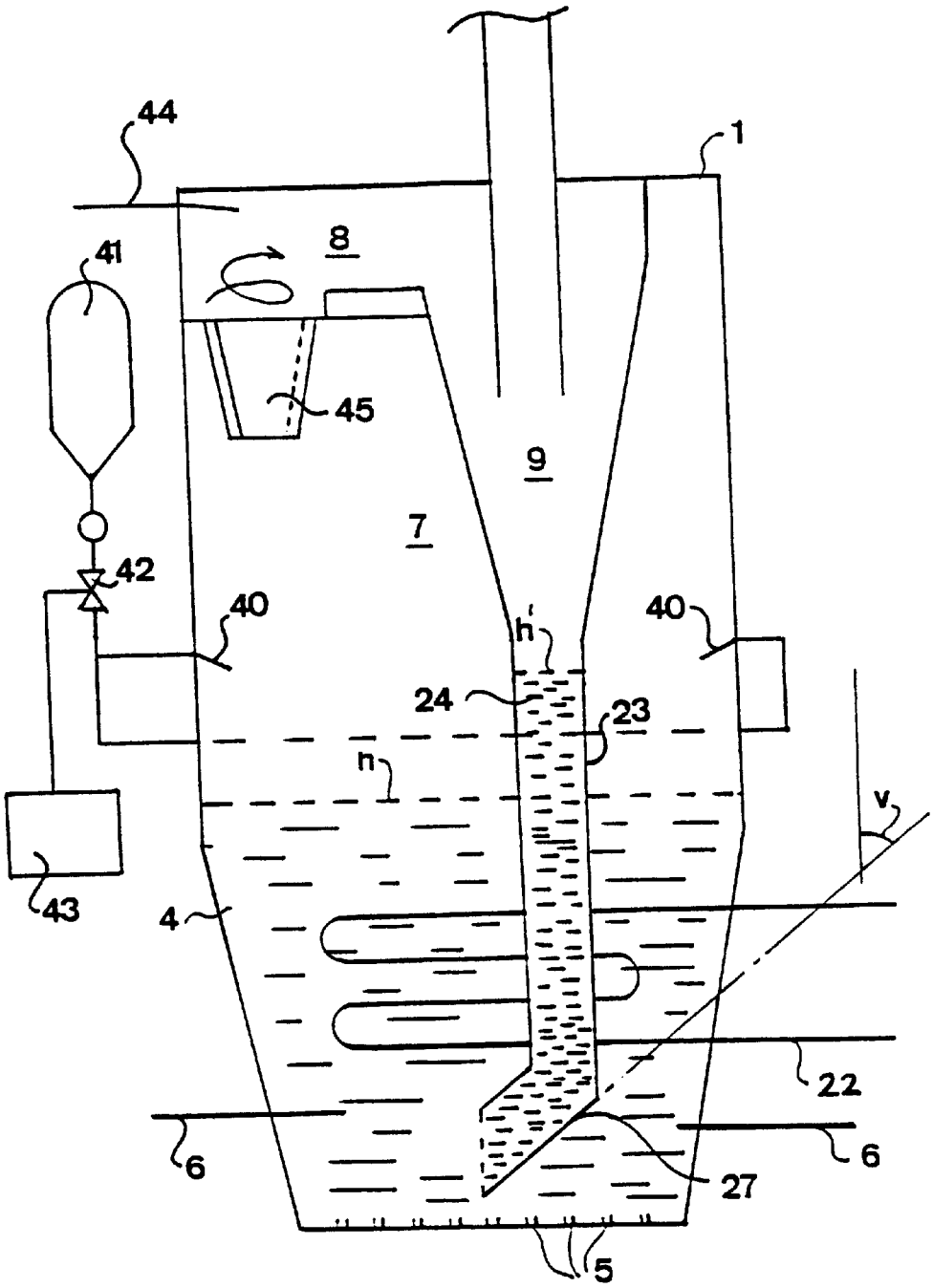

FIG. 4 shows another variant of a recirculation device having a channel 23 extending essentially vertically. In this case the recirculation device comprises a portion 27 of the channel 23 sloping downwardly, which reduces the quantity of gas flowing upwardly in the channel 23 and functions as a sliding surface for the solid particulate material flowing downwardly. The portion 27 forms a passage having a flow area which has such a dimension that a column 24 of material is formed and has a height h' exceeding the height h of the bed 4. The cyclone 9 shown in FIG. 4 is enclosed in the combustion chamber 1 and located in its upper part, i.e. the freeboard 7.

Figure 5:
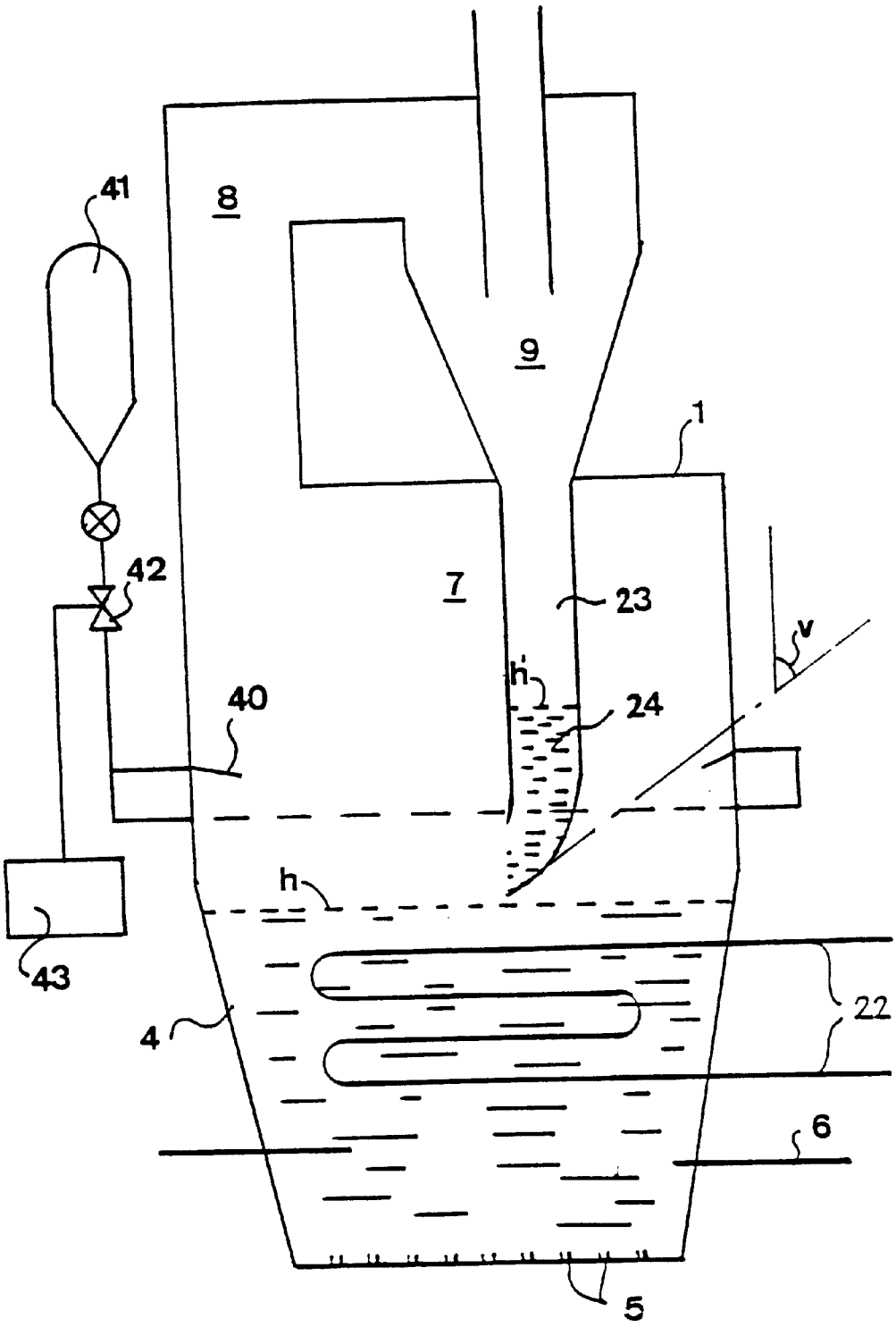

FIG. 5 discloses another variant of a recirculation device having a channel 23 similar to the one in FIG. 2 but has an orifice in the freeboard 7 of the combustion chamber 1.

Figure 9:
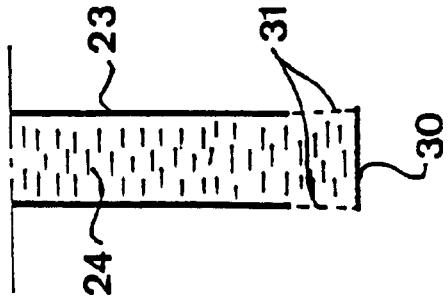
FIGS. 6–12 discloses different embodiments of the recirculation channel.
Figure 8:
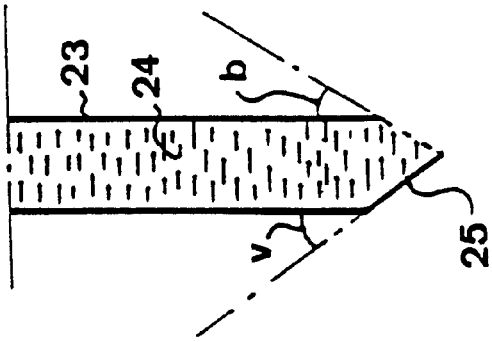
Figure 7:
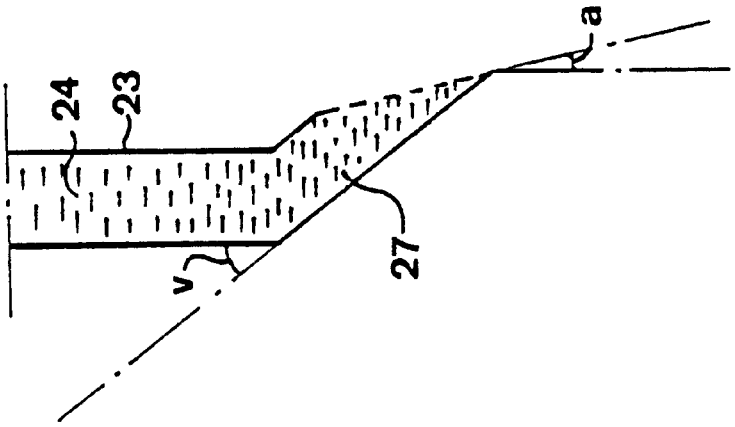
Figure 6:
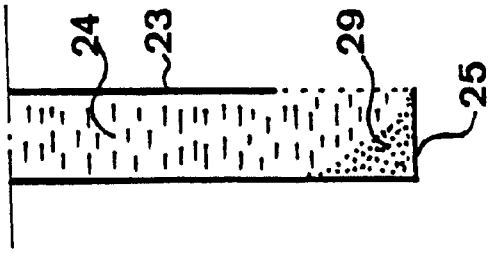
Figure 12:
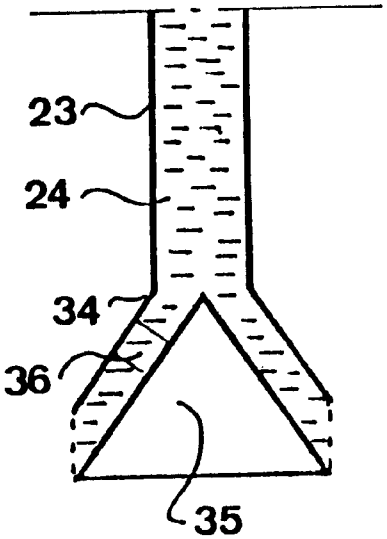
Figure 11:
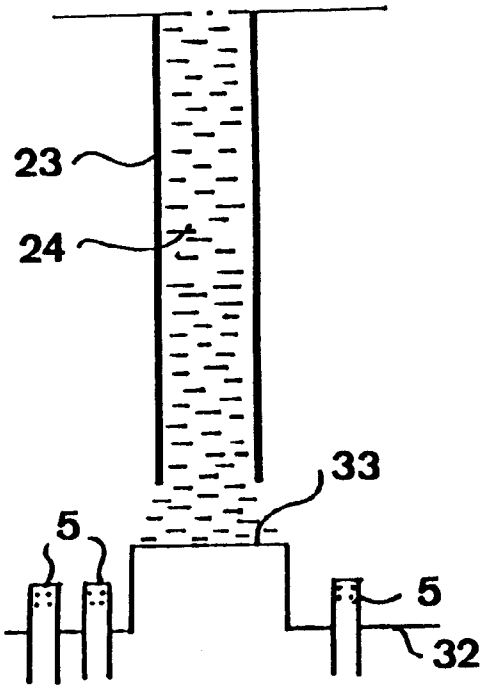
Figure 10:
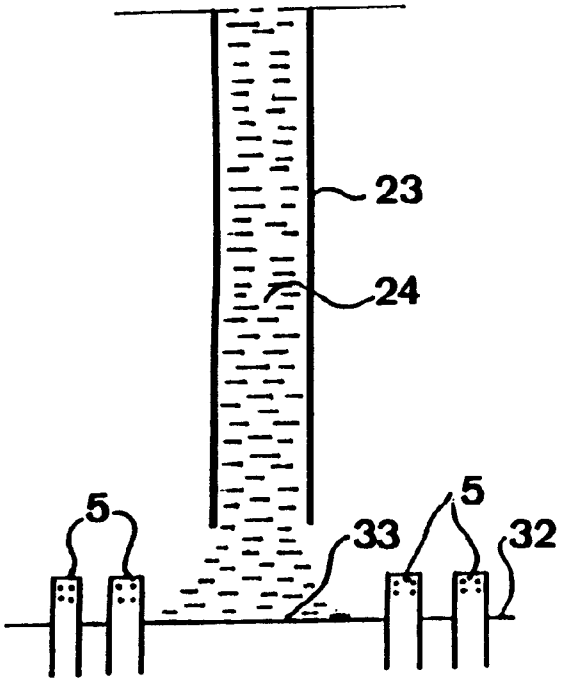

FIGS. 6–12 show further variants of the recirculation device according to the invention. In FIG. 6 this device comprises a channel 23 similar to the one in FIG. 1 but the lower plate 25 extends essentially perpendicular to a vertical axis. This embodiment is especially simple from a manufacturing point of view. There is formed an accumulation 29 of material flowing downwardly in the corner formed by the plate 25 and the channel 23. This accumulation will function as a sliding surface for the material flowing downwardly. The channel 23 disclosed in FIG. 7 comprises a portion 27 similar to the one in FIG. 4 but the lower part of the portion 27 sloping with the angle v is prolonged in the direction of the outflowing material in relation to the upper part of the sloping portion 27. In such a manner the orifice of the channel 23 has an angle a of inclination in relation to a vertical axis. By this embodiment the quantity of gas flowing upwardly into the channel 23 is reduced. The channel disclosed in FIG. 8 is similar to the one shown in FIG. 1 but the plate 25 sloping with the angle v is shortened in such a manner that, as seen from underneath the plate does not cover the whole cross-section area of the channel 23. Thus, the orifice of the channel 23 forms an angle b to a vertical axis. By such an embodiment most of the gas flowing upwardly will certainly be prevented from entering the channel 23 but a part thereof is permitted to mix with the column 24 of material. This may be desirable in certain applications when a gas mixture in the material is to be separated. In FIG. 9 the channel 23 comprises a plate 30 fixed in the channel 23 in such a manner that an essentially peripheral opening is formed between the plate 30 and the channel 23. The plate 30 may be fixed by means of a number of barlike rods schematically disclosed at 31. It should be noted that the plate 30 also may be sloping with an angle v in relation to a vertical axis. The recirculation device disclosed in FIG. 10 comprises a downwardly completely open channel 23 having an orifice precisely above a bottom plate 32 of the combustion chamber 1. In the portion 33 of the bottom plate 32 located below the channel 23 there are no fluidizing nozzles 5 which otherwise are provided over essentially the whole surface of the bottom plate 32. In such a manner no gas flowing upwardly from the nozzles 5 may enter the channel 23 and cause a fluidization of the material present therein. Thereby, a column 24 of material may be built up and a uniform and continuous discharge of material to the lower part of the bed is obtained. The material so discharged will thereafter be brought upwardly in the bed due to the gas flowing upwardly from the nozzles 5. FIG. 11 shows a recirculation device similar to the one in FIG. 10 but the portion 33 provided in the bottom plate 32 and having no fluidizing nozzles 5 is raised in relation to the other surface of the bottom plate 32. The recirculation device disclosed in FIG. 12 comprises the channel 23 having a funnel-shaped conical extension 34 being open downwardly. In this extension 34 a cone is provided by means of one or more attachment plates 36. The extension 34 and the cone 35 form a cone angle v in relation to the vertical axis. This angle v is, as in the preceding example, between 20 and 90°, preferably between 21 and 39°.

Furthermore, the combustion plant according to the invention comprises one or several supply members 40, for example in the form of an injection nozzle, for the supply of a complementary fuel to the freeboard 7 of the combustion chamber 1. This complementary fuel may be the same fuel as supplied to the bed via the conduit 6 as schematically disclosed in FIG. 1 in which both the supply conduit 6 and the supply member 40 are connected to the same fuel container 6A. The complementary fuel may also be supplied from a separate container 41, which is shown in FIGS. 2–4. Thereby, the container 41 may comprise the same fuel as supplied to the bed 4 or any other complementary fuel, for example a particulate fuel or a liquid fuel such as, for instance, paraffin, heavy oil or fuel oil. The container 41 may also comprise a container for storing of a combustible gas supplied to the free board 7 as complementary fuel. It should also be noted that the combination of one or several of these fuels defined may be used as complementary fuel. Furthermore, the complementary fuel supply according to the invention comprises a regulating valve 42 and a control member 43 for controlling the regulating valve. The control member 43 may be connected to the overall control system of the plant and arranged to control the supply of the complementary fuel in dependence of the load state of a plant. During full load, the supply of the complementary fuel may be zero and this supply may be increased to a maximum value during the smallest possible part load operation. In such a manner, it is possible, despite the fact that the plant is not operated at full load, to maintain a high temperature of the combustion gases and thus achieve optimal operation conditions for the gas turbine 13. Furthermore, the combustion plant may comprise members 44, see FIGS. 2, 3 and 4, for the supply of ammonium to the combustion chamber 1. Ammonium reacts to $NO_3$-compounds at a temperature of 750 to 850° C. and forms water and $N_2$. Thus, this reaction is facilitated by the complementary combustion since the temperature at part load operation otherwise would tend to sink below this level.

As is disclosed in FIGS. 2 and 4, the combustion plant according to the invention may also comprise a mixing member 45 provided at the inlet of the channel 8 for the combustion gases. The purpose of this mixing member 45 is to further mix the combustion gases and the hot gases generated during the combustion in connection with the complementary fuel supply. By such a mixing, for instance a reduction of the nitrogen compounds in the combustion gases may be improved by means of for instance ammonium. The mixing member 45, see FIG. 2, may for instance comprise inclined blades of a rotor arrangement, such as a propeller or turbine arrangement. According to another embodiment, see FIG. 4, a mixing member 45 may comprise a hollow frustrum of a cone, divided in an axial plane, the two parts being slightly displaced in relation to each other in such a manner that two opposing slits extend along the cone surface, through which the gases may be introduced. Then, the gases are rotated and are discharged through the upwardly turned, opened bottom of the frustrum of the cone. Such a mixing member is described in SE-A-9304224-0. By means of the mixing member 45 the gases in the freeboard 7 and the channel 8 are rotated in such a manner that the different gases in the freeboard 7 are effectively mixed, which is a precondition for an effective and uniform reduction of $NO_x$, in the whole combustion gas flow.

The present invention is not in any way limited to the embodiments disclosed above but may be varied and modified within a scope of the following claims.

In certain applications of the present invention, it might be advantageous to provide two or more separating members 9 in a parallel configuration with each other. Each separating member 9 is in this case preferably provided with a recirculation channel 23. Such a parallel configuration may for example be necessary in order to achieve an appropriate separation efficiency.

What is claimed is:

1. A combustion method comprising the steps of:

(a) supplying a pressurized, fluidized-bed combustion plant wherein said plant comprises:

(1) a fluidized bubbling bed having fluidizing nozzles, said bed comprising a non-combustible, particulate bed material, particulate absorbent, and a particulate fuel, (2) a heat-exchange tube set submerged in said fluidized bed and mounted above said fluidizing nozzles;

(3) a freeboard above said bed, (4) a separating member mounted above said freeboard, said separating member having walls sealing said separating member from said freeboard, (5) a gas channel above and open to said freeboard and open to the top of said separating member;

(6) a means for preventing, at least partially, entry of gas from below into said gas channel;

(7) a recirculation device abutting, open to, and mounted below said separating member, said device comprising columnar walls and an inclined wall, said columnar walls abutting and open to said separating member said columnar walls extending vertically through said freeboard, through said bed to a position beneath said tube set, wherein said columnar wall having an orifice in a vertical section near the lower edge thereof, said columnar wall abutting said inclined wall, said inclined wall having an upper portion, a lower portion, and an angle of inclination wherein said lower portion of said inclined wall abuts said orifice;

(8) an exhaust stack open to and mounted above said separating member; and (9) a pressure vessel enclosing said bed, said freeboard, said gas channel, said separating device, and said recirculating device;

(b) supplying an oxygen-containing gas through said nozzles thereby fluidizing said bed wherein said bed has a bed height and a fluidization velocity;

(c) supplying an oxygen-containing gas into said pressure vessel thereby pressurizing said vessel to an operating pressure above ambient atmospheric pressure;

(d) supplying a fuel to said bed;

(e) burning said fuel in said bed forming combustion gasses;

(f) supplying a complementary fuel to said freeboard;

(g) burning said complementary fuel in said freeboard forming combustion gasses;

(h) collecting said combustion gasses in said freeboard;

(i) passing said combustion gasses and said particulate material through said gas channel into said separating member;

(j) separating said particulate material from said combustion gasses in said separating chamber;

(k) forming a column of material in said recirculation device;

(l) passing said separated particulate matter through said recirculation device into said fluidized bed; and (m) discharging said combustion gasses from said combustion chamber.

2. A combustion method, according to claim 1, wherein the physical form of said complementary fuel is selected from the group consisting of particulates, liquids, and gasses.

3. A combustion method, according to claim 1, wherein said complementary fuel comprises at least two selected from the group consisting of particulates, liquids, and gasses.

4. A combustion method, according to claim 1, wherein said complementary fuel is supplied during at least a part load operation of the plant to raise the temperature of the combustion gasses.

5. A combustion method, according to claim 1, wherein said particulate absorbent comprises a sulfur-absorbing material.

6. A combustion method, according to claim 1, wherein said particulate absorbent comprises lime.

7. A combustion method, according to claim 1, wherein said particulate absorbent comprises limestone.

8. A combustion method, according to claim 1, wherein said particulate absorbent comprises dolomite.

9. A combustion method, according to claim 1, wherein the height of said column of material in said recirculation device is greater than said bed height.

10. A combustion method, according to claim 1, wherein said fluidization velocity is from about 0.5 to about 2.0 meters/second.

11. A combustion method, according to claim 1, wherein said gas entry preventing means comprises a surface provided at the lower end of said channel which occludes at least a larger portion of the cross-section of said channel.

12. A combustion method, according to claim 1, wherein said surface forms an angle of about 20° to about 90° with respect to the vertical.

13. A combustion method, according to claim 1, wherein said surface forms an angle of about 21° to about 39° with respect to the vertical.

14. A combustion method, according to claim 1, wherein said inclined wall forms an angle of about 20° to about 90° with respect to the vertical.

15. A combustion method, according to claim 1, wherein said inclined wall forms an angle of about 21° to about 39° with respect to the vertical.

16. A combustion method comprising the steps of:

(a) supplying a pressurized, fluidized-bed combustion plant wherein said plant comprises:

(1) a fluidized bubbling bed having fluidizing nozzles, said bed comprising a non-combustible, particulate bed material, particulate absorbent, and a particulate fuel, (2) at least a first fuel supply member arranged to supply fuel to the bed, (3) at least a second fuel supply member arranged to supply fuel to the freeboard, (4) a supply means to supply absorbent to said plant, (5) a heat-exchange tube set submerged in said fluidized bed and mounted above said fluidizing nozzles;

(6) a freeboard above said bed, (7) a separating member mounted above said freeboard, said separating member having walls sealing said separating member from said freeboard, (8) a gas channel above and open to said freeboard and open to the top of said separating member;

(9) a means for preventing, at least partially, entry of gas from below into said gas channel;

(10) a recirculation device abutting, open to, and mounted below said separating member, said device comprising columnar walls and an inclined wall, said columnar walls abutting and open to said separating member said columnar walls extending vertically through said freeboard, through said bed to a position beneath said tube set, wherein said columnar wall having an orifice in a vertical section near the lower edge thereof, said columnar wall abutting said inclined wall, said inclined wall having an upper portion, a lower portion, and an angle of inclination wherein said lower portion of said inclined wall abuts said orifice;

(11) an exhaust stack open to and mounted above said separating member; and

(12) a pressure vessel enclosing said bed, said freeboard, said gas channel, said separating device, and said recirculating device;

(b) supplying an oxygen-containing gas through said nozzles thereby fluidizing said bed wherein said bed has a bed height and a fluidization velocity;

(c)supplying an oxygen-containing gas into said pressure vessel thereby pressurizing said vessel to an operating pressure above ambient atmospheric pressure;

(d) supplying a fuel to said bed;

(e) burning said fuel in said bed forming combustion gasses;

(f) supplying a complementary fuel to said freeboard;

(g) burning said complementary fuel in said freeboard forming combustion gasses;

(h) collecting said combustion gasses in said freeboard;

(i) passing said combustion gasses and said particulate material through said gas channel into said separating member;

(j) separating said particulate material from said combustion gasses in said separating chamber;

(k) forming a column of material in said recirculation device;

(l) passing said separated particulate matter through said recirculation device into said fluidized bed; and (m) discharging said combustion gasses from said combustion chamber.

17. A combustion method, according to claim 16, wherein said second fuel supply member is disposed to supply a particulate fuel.

18. A combustion method, according to claim 16, wherein said second fuel supply member is disposed to supply a liquid or a gaseous fuel.

19. A combustion method, according to claim 16, wherein said second fuel supply member is disposed to supply the same fuel as said first fuel supply member.

20. A combustion method, according to claim 16, wherein said second fuel supply member is disposed to supply at least two selected from the group consisting of particulates, liquids, and gasses.

21. A combustion method, according to claim 16, wherein the height of said column of material in said recirculation device is greater than said bed height.

22. A combustion method, according to claim 16, wherein said gas entry preventing means comprises a surface provided at the lower end of said channel which occludes at least a larger portion of the cross-section of said channel.

23. A combustion method, according to claim 16, wherein said surface forms an angle of about 20° to about 90° with respect to the vertical.

24. A combustion method, according to claim 16, wherein said surface forms an angle of about 21° to about 39° with respect to the vertical.

25. A combustion method, according to claim 16, wherein the height of said bed is from about 2 to about 6 meters.

26. A combustion method, according to claim 16, wherein a mixing member is provided in said freeboard to mix said combustion gasses with said fuel supplied by said second fuel member.

27. A combustion method, according to claim 16, wherein a supply member is disposed to supply ammonia to the combustion plant.

28. A combustion method, according to claim 16, wherein said operating pressure is from about 7 to about 30 bars.

29. A combustion method, according to claim 16, wherein said inclined wall forms an angle of about 20° to about 90° with respect to the vertical.

30. A combustion method, according to claim 16, wherein said inclined wall forms an angle of about 21° to about 39° with respect to the vertical.

* * * * *